United States Patent [19]

Letzo et al.

[11] Patent Number: 4,741,356

[45] Date of Patent: May 3, 1988

[54] HYDRANT VARIABLE RISER AND RESTRAINT

[75] Inventors: Richard C. Letzo; Joseph R. James, both of Sarasota, Fla.

[73] Assignee: Assured Flow Sales, Inc., Sarasota, Fla.

[21] Appl. No.: 894,854

[22] Filed: Aug. 8, 1986

[51] Int. Cl.[4] ..... E03B 9/02

[52] U.S. Cl. ..... 137/272; 137/236.1; 137/615; 285/184; 285/410

[58] Field of Search ..... 137/272, 276, 279, 615, 137/363, 364, 236.1, 277; 285/181, 184, 93, 410

[56] References Cited

U.S. PATENT DOCUMENTS

| | | | |
|---|---|---|---|
| 117,316 | 7/1871 | Neall | 137/295 X |
| 381,008 | 4/1888 | Gould | 285/181 X |
| 1,304,980 | 5/1919 | Hirshstein | 285/184 |
| 2,188,069 | 1/1940 | Walsh | 285/93 X |
| 2,490,640 | 12/1949 | Lefevre-Selmer | 285/410 |
| 2,706,649 | 4/1955 | Foushee | 285/410 X |
| 2,720,079 | 10/1955 | Mines | 285/410 X |
| 2,957,489 | 10/1960 | Fisher | 137/615 X |
| 3,236,266 | 2/1966 | Bily | 137/236.1 X |
| 3,572,408 | 3/1971 | Hnot | 137/236.1 X |
| 4,176,864 | 12/1979 | Pohl et al. | 285/181 |

FOREIGN PATENT DOCUMENTS

| | | | |
|---|---|---|---|
| 403823 | 3/1974 | U.S.S.R. | 137/272 |

OTHER PUBLICATIONS

Title: Pipe Economy; Author: Clow Corporation; Date: 1975; Pages: Front Cover, p. 21 Index; pp. 49 and 79.

Title: Handbook, Ductile Iron Pipe/Cast Iron Pipe 4th Edition; Author: Cast Iron Pipe Research Association; Pages: Front Cover, pp. 416 and 46.

*Primary Examiner*—Martin P. Schwadron
*Assistant Examiner*—Stephen M. Hepperle
*Attorney, Agent, or Firm*—Charles J. Prescott

[57] ABSTRACT

A variable riser conduit for the adjustable vertical positioning of a fire hydrant both in conjunction with, and subsequent to, completing the hydrant installation. The riser conduit is formed of a housing which may be tubular, having a passageway therethrough and also having annular collars disposed around and adjacent each end margin of the passage. These collars cooperate with mating flanges on the shoe of the hydrant at one end and the water main or auxiliary valve at the other end to provide a water tight mechanically restrained joint when a split restraint collar is secured and tightened in place behind each annular collar. The ends of the passage are parallel and laterally offset or disposed one to another such that, when the restraint collar is loose or loosened, the riser conduit may be rotated with respect to both hydrant and water main. Because the water main is fixed within the ground, only the height of the hydrant is varied to a desired upright repositioning with respect to grade level before the split restraint collars are retightened.

9 Claims, 1 Drawing Sheet

Fig. 1
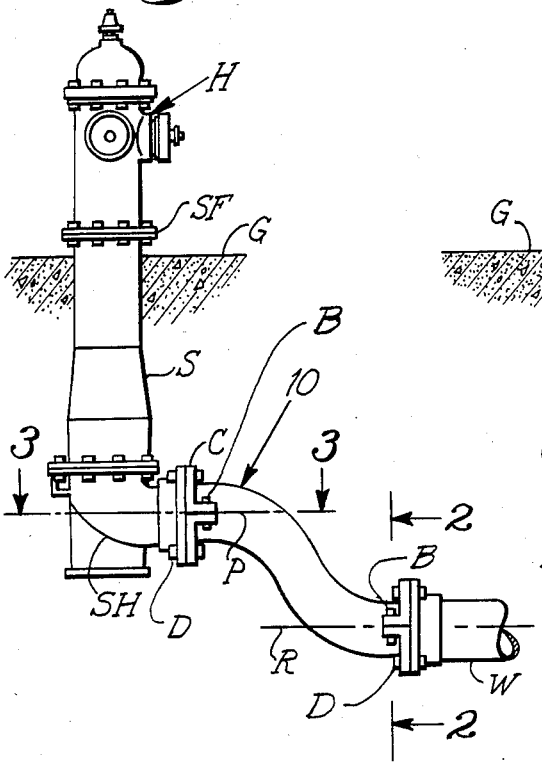
Fig. 2
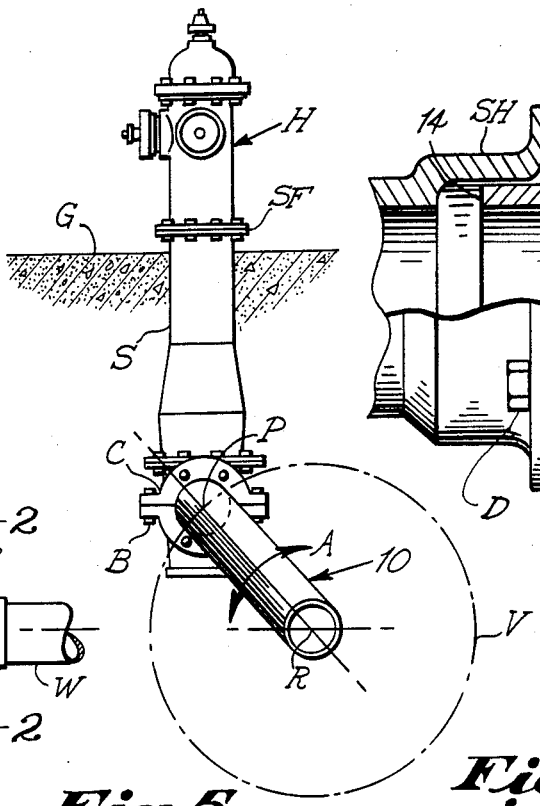
Fig. 3
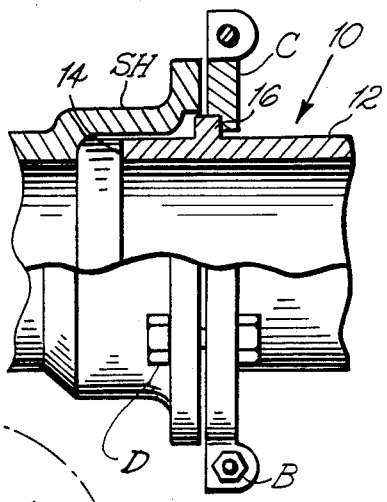
Fig. 4
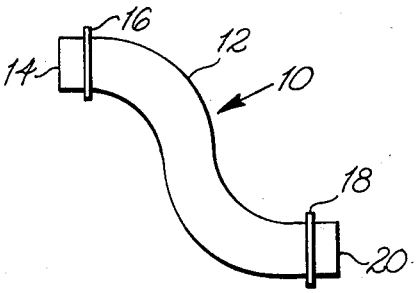
Fig. 5
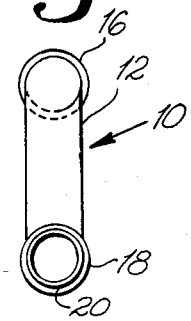
Fig. 7
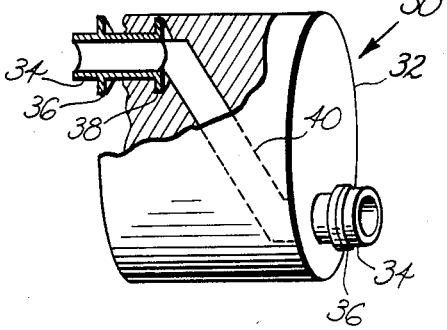
Fig. 6
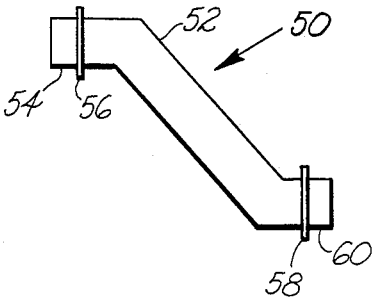
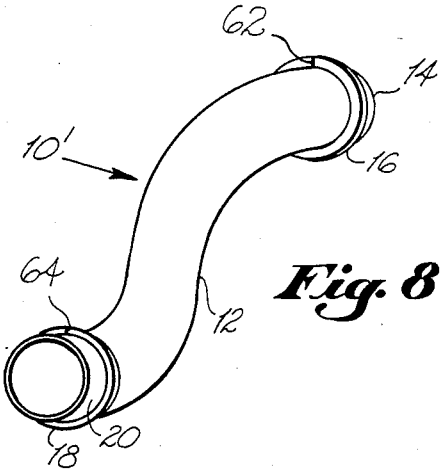
Fig. 8

HYDRANT VARIABLE RISER AND RESTRAINT

BACKGROUND OF THE INVENTION

This invention relates generally to fittings to water main systems, and more particularly to a riser conduit which provides variable height positioning of fire hydrants both during and after installation.

The procedure for installing civil fire hydrants in communities has remained essentially the same since the turn of this century. There have been only three noteworthy improvements with respect to the basic installation procedure of fire hydrants during this period, which were the addition of a watch or auxiliary valve, improvements in water thrust restraint as water is directed upwardly into and through the fire hydrant, and the addition of the safety flange break-off feature. Watch valves were introduced to facilitate water supply shut-off directly adjacent the hyrant during routine maintenance, including the height adjustment procedures herebelow described.

In most instances where a commercial water supply system is installed into a residential or commercial development, the final grade level of the area is uncertain. Even in instances where the final grade level is tentatively established, subsequent finalizations of road and curb grade, as well as landscaping alterations, render the initial height positioning of fire hydrants inappropriate. Landscape design often adds or deletes soils around the fire hydrant, thus either unduly exposing or improperly burrying the safety flange. Because it is important to the "breakaway" feature of fire hydrants that the "breakaway" safety joint be fixed at or near grade level, height adjustment of the fire hydrant, responsive to these subsequent alterations of grade, require that the height of the fire hydrant be also altered to re-establish the breakaway joint at or near grade level.

The procedure for inserting extension sections to raise the safety flange of the fire hydrant is so well established that most if not all of the fire hydrant manufacturers currently issue standard written descriptions, including photographs, depicting the procedure for disassembling the fire hydrant at the safety flange and inserting the appropriate extending section (which that company usually manufactures in standard lengths) between the standing pipe and the fire hydrant. These procedures, in conjunction with the standard available lengths of extensions, indirectly describe a further limitation of the present procedure, to wit, the ideal height for the safety flange may not be obtainable because the standard overall lengths of extensions are generally in six inch increments.

The long established and current procedure for adjusting the fire hydrant to the proper grade elevation involves the interruption of water main supply to the fire hydrant and the excavation of the lower barrel or standpipe which interconnects the exposed portion of the fire hydrant and the lower shoe which interconnects to the water main or watch valve. The length of this standpipe, once removed, must be either increased by the addition of extensions, or reduced by installing a shorter length standpipe. Therefore, these subsequent variations in ground level or grade adjacent the fire hydrant are costly and time consuming.

Applicant knows of no less expensive or expeditious method or device currently available on the market which is adapted both to be compatible with the present means for sealing and restraining the fire hydrant against water thrust, as well as providing an economical and expeditious means for varying fire hydrant height responsive to grade variations.

The present invention provides a variable riser conduit which is shaped and adapted to be compatible with presently used mechanical restraint-type joints and also provides for easy and convenient alteration of the vertical positioning of the fire hydrant, either during or subsequent to initial installation, without replacing other components. By excavating the area around the fire hydrant to provide access to this invention, by simply loosening the mechanical joints at either end of this riser conduit, the unit may be rotated with respect to both water main or watch valve and fire hydrant to provide the desired new infinity variable hydrant height positioning within the offset size range of each particular riser conduit. Thereafter, the mechanical restraint joint may be retightened to reattain full sealing and mechanical thrust restraint.

BRIEF SUMMARY OF THE INVENTION

This invention is directed to a variable riser conduit for the adjustable vertical positioning of a fire hydrant both in conjunction with, and subsequent to, completing the hydrant installation. The riser conduit is formed of a housing which may be tubular, having a passageway therethrough and also having annular collars disposed around and adjacent each end margin of the passage. These collars cooperate with mating flanges on the shoe of the hydrant at one end and the water main or auxiliary valve at the other end to provide a water tight mechanically restrained joint when a split restraint collar is secured and tightened in place behind each annular collar. The ends of the passage are parallel and laterally offset or disposed one to another such that, when the restraint collar is loose or loosened, the riser conduit may be rotated with respect to both hydrant and water main. Because the water main is fixed within the ground, only the height of the hydrant is varied to a desired upright repositioning with respect to grade level before the split restraint collars are retightened.

It is therefore an object of this invention to provide a variable riser conduit which is compatible with existing mechanical joint restraints with respect to fire hydrants and water main supplies and which will provide variable height positioning and repositioning of the fire hydrant without the addition or substitution of components.

It is another object of this invention to provide riser conduit means for easy and convenient height adjustment of fire hydrants in conjunction with alterations in grade level.

It is another object of this invention to provide a variable riser conduit as set forth above adaptable to various manufacturing processes.

In accordance with these and other objects which will become apparent hereinafter, the instant invention will now be described with reference to the accompanying drawings in which:

BRIEF DESCRIPTION OF THE DRAWINGS

FIG. 1 is a side elevation view of the invention in place between a water main and a fire hydrant.

FIG. 2 is an end elevation view of the invention in place as seen in the direction of arrows 2—2 in FIG. 1.

FIG. 3 is a section view in the direction of arrows 3—3 in FIG. 1.

FIG. 4 is a side elevation view of the invention.

FIG. 5 is a right end elevation view of the invention.

FIG. 6 is a side elevation view of another embodiment of the invention.

FIG. 7 is a perspective broken view of yet another embodiment of the invention.

FIG. 8 is a perspective view of yet another embodiment of the invention.

DETAILED DESCRIPTION OF THE INVENTION

Referring now to the drawings, and particularly to FIGS. 1 and 2, a standard fire hydrant H is shown installed in its proper vertical position with respect to grade level G of the surrounding terrain. Fire hydrants generally, in their standard form include a safety flange SF which is designed to break off when impacted by a vehicle such that the stand pipe S therebelow is undamaged as a result of such impact.

Where the safety flange SF is placed well above grade G, vehicle impact will result in damage to at least the standpipe S, and additionally may damage therebelow-positioned hydrant shoe SH, and possibly even additional components of the water main supply structure W or watch valve (not shown). Likewise, where the safety flange SF ultimately is burried beneath the grade G, vehicle impact against the fire hydrant will not result in the effective fragmentation of the safety flange SF, possibly resulting in additional vehicle damage and occupant injury due to increased impact severity.

The present invention shown generally at numeral 10 is positioned and installed between the water main W and the shoe SH of the fire hydrant H. Referring additionally to FIGS. 4 and 5, the invention 10 generally includes a housing 12 having a passageway therethrough connecting ends 14 and 20. Adjacent the margins of ends 14 and 20 are rigidly connected or integral external annular collars 16 and 18 which are transversely disposed with respect to the axis passing through the housing 12 at these end points.

As best seen in FIG. 3, the end of the housing 14 is mateably insertable into the enlarged portion of shoe SH as shown. After insertion thusly, split collar C is assembled together by bolts B around the housing 12, said split collar C adapted to mate against the annular collars 16 and 18 as shown. After split collar assembly bolts B have been tightened, restraining bolts D are fitted through mating and aligning apertures in both the split collar C and the flange of the shoe SH. By this means, then, the threaded bolts D may be tightened to draw the split collar C against the flange of shoe SH to restrain the end 14 of the riser conduit 10 in its assembled position for use as shown.

The identical connection as previously described is utilized at the opposite end 20 of the housing 12 with respect to assembly to the water main W. Alternately, a watch or auxiliary shutoff valve (not shown) may be assembled to this end 20 of the housing 12 fitted between the water main W and the riser conduit 10 to facilitate service of the fire hydrant H and also to prevent water leakage during height adjustment of the fire hydrant H in the manner provided by the present invention as herebelow described.

Referring particularly now to FIGS. 1, 2 and 3, once the riser conduit 10 has been assembled between and against the shoe SH and the water main W, and prior to the tightening of bolts D, the riser conduit 10, in the absence of surrounding earthen materials, may be freely rotated back and forth in the direction of arrow A in FIG. 2. Because the water main W is generally fixed within the ground, the rotation of the riser conduit 10 as described results in the axis P passing through the end 14 of the housing 12 moving along a circle V. This rotation of the riser conduit 10, therefore, has the effect of positioning the axis P vertically anywhere within the limit of imaginary circle V. Because the fire hydrant H is always maintained in its final position in an upright position as shown, the vertical positioning of the hydrant is directly related, then, to the angular positioning of the riser conduit 10 with respect to axis R of the water main W.

Although the lateral positioning of the fire hydrant H is also effected somewhat by the particular rotational orientation of the riser conduit 10, this lateral variation is easily accommodated when the surrounding earthen material is refilled to the desired grade level at G.

After the proper rotational orientation of riser conduit 10 is achieved, along, particularly, with the associated new height of the safety flange SF with respect to grade G, the flange bolts D are then tightened to secure the water integrity of the joints at either end of the riser conduit 10 and to secure the angular orientation between all components.

The embodiment of the invention shown in FIGS. 1 through 5 is fabricated of a contoured length of rigid tubing with the annual collars 16 and 18 resistance welded or heat shrunk into permanent rigid position on the housing 12 and with respect to the end margins. The overall contour of the housing 12 is of uniform radius sinuous contour to minimize resistance and reaction to pressurized water flow therethrough.

Referring now to FIG. 6, another embodiment of the invention is shown generally at 50 having a housing 52 which includes a generally diagonally disposed midportion interconnecting ends 54 and 60. As in all embodiments of the invention, annular collars 56 and 58 are rigidly disposed adjacent the end margins and transversly about the outer surface of the housing 52. This embodiment, although not preferred, is somewhat easier to manfuacture.

Referring now to FIG. 7, another embodiment of the invention is shown generally at 30 and includes an enlarged cylindrical housing 32 having a circular cross section and including passage 40 therein. This passage 40 is diagonally disposed as shown and is in fluid communication with end couplings 34 which are embedded within the enlarged housing 32. The end couplings 34 include annular collars 36 which are structured and function as previously described for retention of the riser conduit 30 within the fire hydrant shoe SH and the water main W. These end couplings 34 are, preferrably, cast formed within a concrete housing 32 and include enlarged flanges 38 which serve to provide additional strength to resist water thrust against the fire hydrant show SH as water is redirected upwardly and out of the fire hydrant H.

Referring lastly to FIG. 8, another embodiment of the invention is shown generally at 10' and is substantially similar to that previously described with respect to FIGS. 1 through 5, except for the additional of indicia marks 62 and 64 placed on the annular collars 16 and 18. These indicia marks are aligned at the same angular orientation one to another with respect to the ends 14 and 18 of housing 12 and are also positioned at the upper most portion of annular collars 16 and 18. These indicia are provided to be viewed in alignment and registry with mating indicia formed into the flanges of the shoe SH and water main W to facilitate height measurement and ease of aligning the fire hydrant F in an upright position without the aid of auxiliary equipment.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A variable riser conduit connectable between a fixed below grade water main and a fire hydrant for adjustable vertical positioning of the fire hydrant with respect to the water main comprising:

a housing having an elongated continuous passage therethrough;

said passage having an inlet portion at one end, an outlet portion at the other end, and a central portion therebetween along a common axis therethrough;

said passage configured such that said axis portions passing through said inlet and outlet portions are parallel and spaced apart;

said inlet portion sized for releasable water tight interconnection to the water main;

said outlet portion sized for releasable water tight interconnection to the inlet shoe of the fire hydrant;

said housing having an external annular collar adjacent to but spaced from said one end;

said housing having an external annular collar adjacent to but spaced from said other end;

said housing manually rotatable when loosely interconnected between the water main and the fire hydrant such that the vertical positioning of the fire hydrant is varied according to the rotational positioning of said housing; and said housing nonrotatable when said housing is tightly connected to the fire hydrant and the water main.

2. A variable riser conduit as set forth in claim 1, wherein:

said housing is tubular.

3. A variable riser conduit as set forth in claim 2, wherein:

said passage contour is sinuous.

4. A variable riser conduit as set forth in claim 2, wherein:

said passage central portion is diagonal between said inlet and outlet portions.

5. A variable riser conduit as set forth in claim 1, wherein:

said housing is enlarged and cylindrical and having a transverse perimeter encompassing the entire axis of said passage;

said passage central portion formed within said housing;

said inlet and outlet portions separately formed and including said annular collars and rigidly embedded into said cylindrical housing in fluid communication with said passage central portion.

6. A variable riser conduit as set forth in claim 5, wherein:

said passage contour is sinuous.

7. A variable riser conduit as set forth in claim 5, wherein:

said passage central portion is diagonal between said inlet and outlet portions.

8. A variable riser conduit as set forth in claim 1, wherein:

said annular collars include alignment indicia adapted to be viewed in registry with said fire hydrant and said water main for assisting in vertical alignment and height positioning of the fire hydrant.

9. A variable riser conduit for interconnection between the shoe of a fire hydrant and a water main, said riser conduit for varying the vertical positioning of the fire hydrant with respect to the water main, said riser conduit comprising:

a continuous elongated tubular member having open ends which are sized to be inserted into the fire hydrant shoe and the water main;

said tubular member having an outwardly disposed annular collar adjacent each said end;

said annular collar is sized for releasable engagement with a split restraint collar which acts in cooperation with the shoe flange on the fire hydrant and the flange at the end of the water main to retain said ends in the fire hydrant and the water main;

said tubular member configured such that said ends are generally parallel and laterally spaced apart;

said riser conduit rotatable in the fire hydrant and the water main when said split restraint collar at each said end is loosened such that the height of the fire hydrant is varied in relation to the water main; and said riser conduit nonrotatable in the fire hydrant and the water main when each said split restraint collar is tightened.

* * * * *